US007931708B2

(12) United States Patent
Lee et al.

(10) Patent No.: US 7,931,708 B2
(45) Date of Patent: Apr. 26, 2011

(54) REFORMER BURNER

(75) Inventors: Dong-woo Lee, Yongin-si (KR); Tae-sang Park, Yongin-si (KR)

(73) Assignee: Samsung SDI Co., Ltd., Gyeonggi-do (KR)

( * ) Notice: Subject to any disclaimer, the term of this patent is extended or adjusted under 35 U.S.C. 154(b) by 1087 days.

(21) Appl. No.: 11/703,133

(22) Filed: Feb. 7, 2007

(65) Prior Publication Data

US 2008/0010900 A1 Jan. 17, 2008

(30) Foreign Application Priority Data

Jul. 11, 2006 (KR) ..... 10-2006-0064857

(51) Int. Cl.
*B01J 7/00* (2006.01)

(52) U.S. Cl. ..... 48/61; 422/197; 422/198; 422/211; 48/127.9; 48/95; 48/214; 48/215; 431/363; 431/242

(58) Field of Classification Search ..... 422/190, 422/193, 195; 431/7
See application file for complete search history.

(56) References Cited

U.S. PATENT DOCUMENTS

| | | | | |
|---|---|---|---|---|
| 4,597,734 | A * | 7/1986 | McCausland et al. | 431/328 |
| 4,692,306 | A * | 9/1987 | Minet et al. | 422/49 |
| 4,789,331 | A * | 12/1988 | Kawamura | 431/262 |
| 7,556,875 | B2 * | 7/2009 | Mukai et al. | 429/423 |
| 7,628,963 | B2 * | 12/2009 | Woo et al. | 422/190 |
| 2003/0093950 | A1 * | 5/2003 | Goebel et al. | 48/197 R |
| 2003/0129555 | A1 | 7/2003 | Mukai et al. | |
| 2005/0053816 | A1 * | 3/2005 | Bhargava et al. | 429/26 |

FOREIGN PATENT DOCUMENTS

| | | | |
|---|---|---|---|
| CN | 1430302 | A | 7/2003 |
| JP | 8-217401 | | 8/1996 |
| JP | 2005-285853 | * | 9/2005 |
| KR | 2006-54748 | | 5/2006 |

OTHER PUBLICATIONS

Office Action issued by the Chinese Patent Office on Feb. 13, 2009.

* cited by examiner

*Primary Examiner* — Alexa D. Neckel
*Assistant Examiner* — Kaity V. Handal
(74) *Attorney, Agent, or Firm* — Lee & Morse P.C.

(57) ABSTRACT

A reformer burner that includes a fuel supply tube through which a fuel is supplied and a fuel supply chamber that surrounds the fuel supply tube and has a plurality of atomizing holes to atomize a fuel into a combustion chamber of a reformer.

14 Claims, 8 Drawing Sheets

REFORMER BURNER

CROSS-REFERENCE TO RELATED PATENT APPLICATIONS

This application claims the benefit of Korean Application No. 2006-64857, filed Jul. 11, 2006, in the Korean Intellectual Property Office, the disclosure of which is incorporated herein in its entirety by reference.

BACKGROUND OF THE INVENTION

1. Field of the Invention

Aspects of the present invention relate to a burner for heating a reformer that generates hydrogen, and more particularly, to a reformer burner that has increased combustion efficiency.

2. Description of the Related Art

A fuel cell is a system that directly transforms the chemical energy of oxygen and hydrogen from hydrocarbon group materials such as methanol, ethanol, or natural gas into electrical energy.

A fuel cell system includes a fuel cell stack and a fuel processor (FP) as main components, and includes a fuel tank and a fuel pump as supplementary components. The fuel cell stack is a stacked structure which comprises a few to many unit cells, each unit cell being composed of a membrane electrode assembly (MEA) and a separator.

FIG. 1 is a block diagram illustrating a configuration of a fuel cell system 100. Referring to FIG. 1, a fuel 105 that contains hydrogen atoms is reformed into hydrogen gas in a fuel processor 102, and the hydrogen gas is supplied to a fuel cell stack 130. In the fuel cell stack 130, electrical energy is generated by an electrochemical reaction between the hydrogen and oxygen.

The fuel processor 102 includes a desulphurizer 110 and a hydrogen generator 120. The hydrogen generator 120 includes a reformer 122 and a shift reactor 124.

The desulphurizer 110 removes sulfur from the fuel 105 so that a catalyst of the reformer 122 and the shift reactor 124 are not poisoned by a sulfur compound.

The reformer 122 generates hydrogen, carbon dioxide, and carbon monoxide, through the reformation of a hydrocarbon material. Carbon monoxide can poison the catalytic layers of the electrodes in the fuel cell stack 130. Therefore, a reformed fuel should not be directly supplied to the fuel cell stack 130. Accordingly, the shift reactor 124 that removes carbon monoxide from the fuel is required. The shift reactor 124 may reduce the content of the carbon monoxide in the reformed fuel to less than 10 ppm.

A reformer burner (not shown) heats an inner space (combustion chamber) of the reformer 122 to approximately 750° C. to reform a hydrocarbon that passes the catalyst of the reformer 122.

FIG. 2 is a cross-sectional view of a reformer 10. Referring to FIG. 2, a reformer burner 11 having a pipe shape is installed in a combustion chamber 12, which is an inner space of a reformer 10. A reformer catalyst 13 is disposed on the outer surface of the combustion chamber 12. A fuel and air supplied to the reformer burner 11 are ignited using an ignition source (not shown), and combustion gases are exhausted out through a gas outlet 15. It is advantageous to the reforming efficiency of a hydrocarbon for the reformer catalyst 13 to be uniformly heated to a temperature of 700 to 750° C.

FIG. 3 is a diagram showing a simulation result of a temperature profile of the reformer 10 of FIG. 2. Referring to FIG. 3, when the reformer burner 11 has a pipe shape, the temperature range of the reformer catalyst 13 is from 600 to 825° C., and the large temperature difference reduces the reforming efficiency of the reformer 10.

SUMMARY OF THE INVENTION

Aspects of the present invention provide a reformer burner that can decrease the temperature differences throughout the reformer catalyst arranged about a combustion chamber.

According to an aspect of the present invention, there is provided a reformer burner that extends into a combustion chamber to heat a reformer catalyst arranged about a combustion chamber, the reformer comprises: a combustion chamber. a fuel supply tube through which a fuel is supplied; and a fuel supply chamber that surrounds the fuel supply tube and has a plurality of atomizing holes to atomize a fuel into the combustion chamber of the reformer.

The atomizing holes may have a diameter of 0.76 mm or less.

The fuel supply chamber may be formed of a heat resistant metal or a ceramic material. The fuel supply chamber may be formed of SUS301 stainless steel, and the fuel supply chamber may also be formed of alumina.

The fuel supply tube is disposed on a lower central portion of the fuel supply chamber, and the fuel supply chamber is disposed on a lower central portion of the reformer.

The reformer burner may further comprise a mesh cylinder on a distal end of the fuel supply tube.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
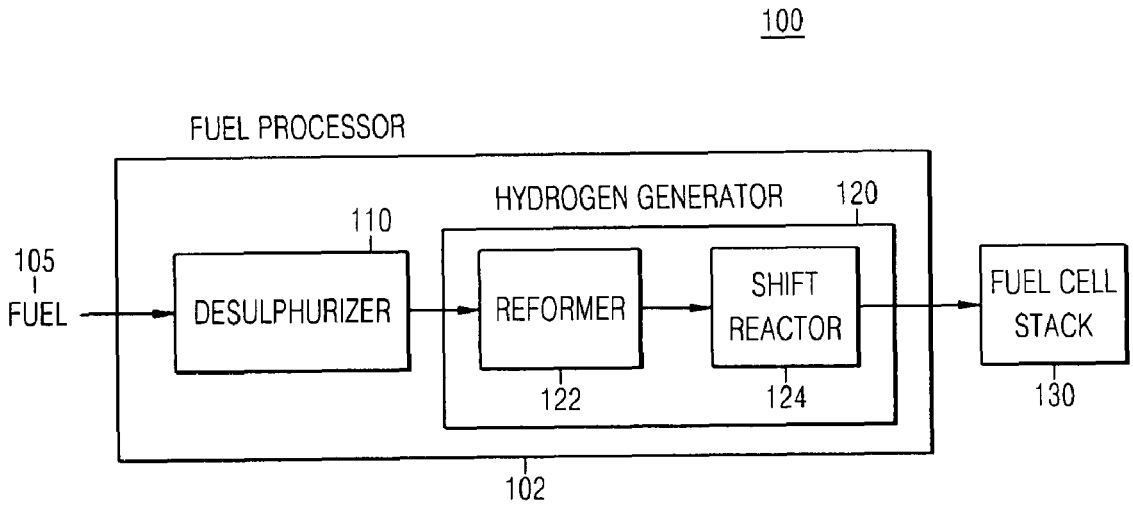
FIG. 1 (RELATED ART)
FIG. 1 is a block diagram illustrating a configuration of a conventional fuel cell system.
Figure 2:
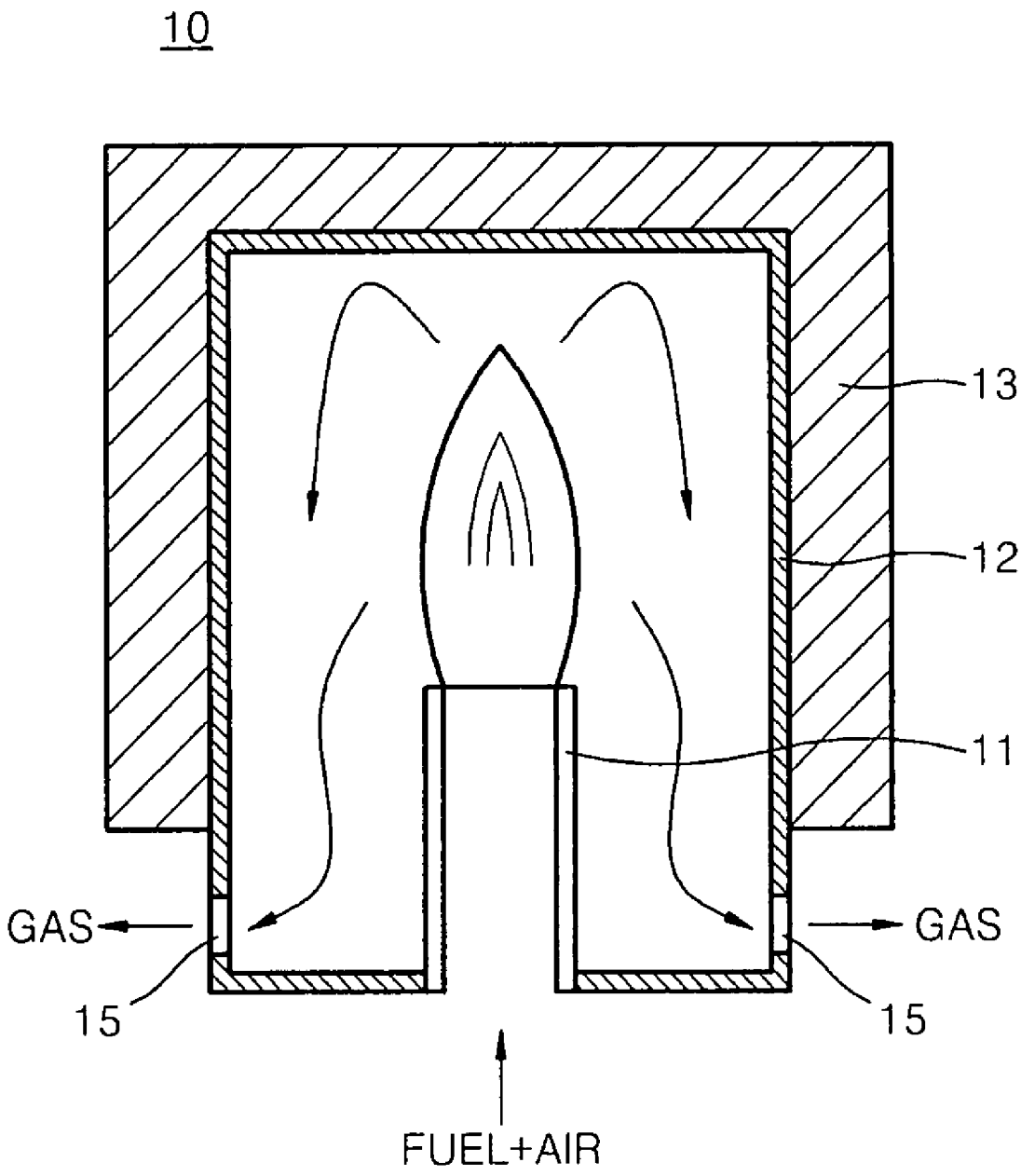
FIG. 2 (RELATED ART)
FIG. 2 is a cross-sectional view illustrating a structure of a conventional reformer.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
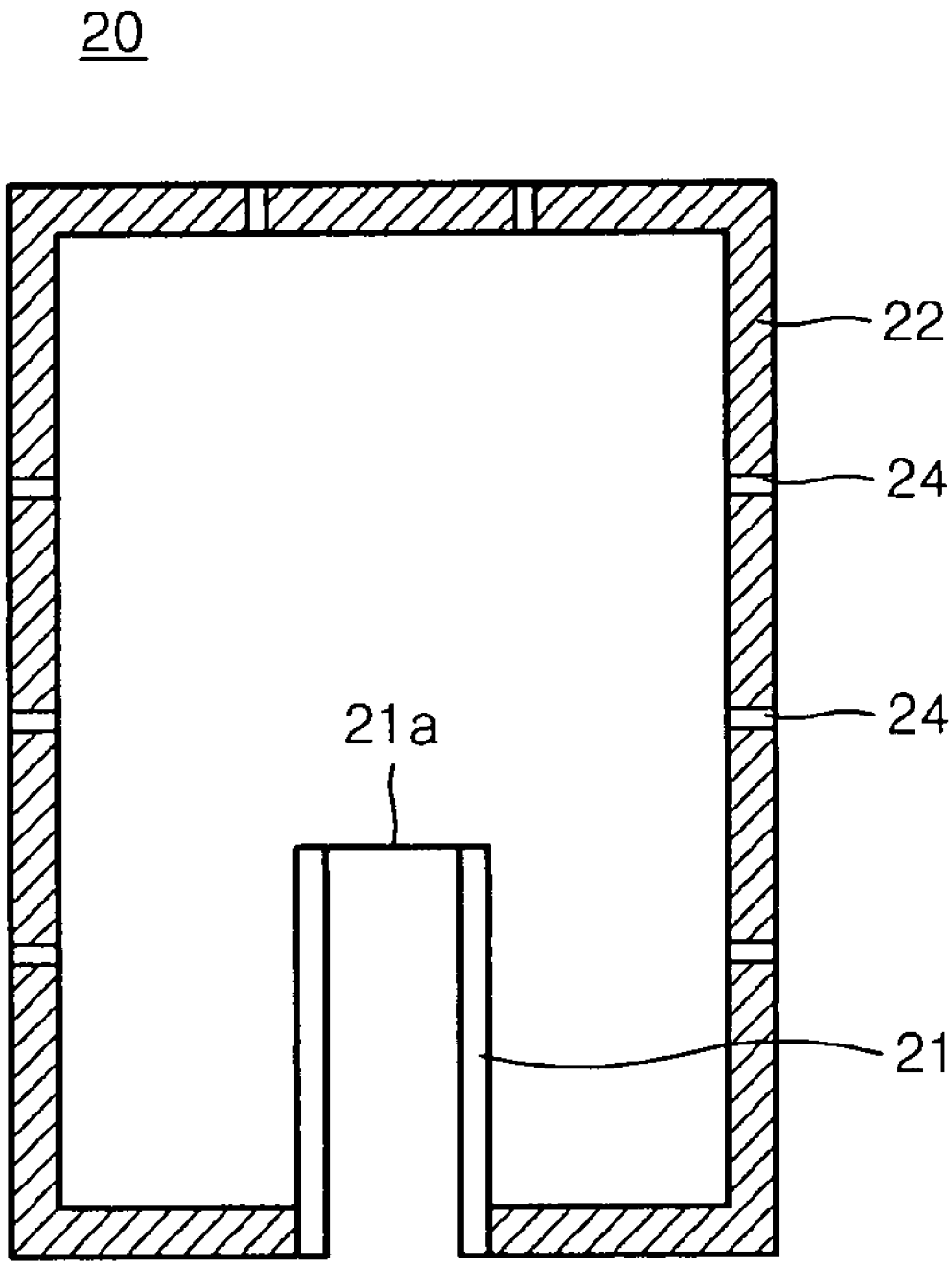
FIG. 4 is a cross-sectional view illustrating a structure of a reformer burner according to an embodiment of the present invention.
Figure 5:
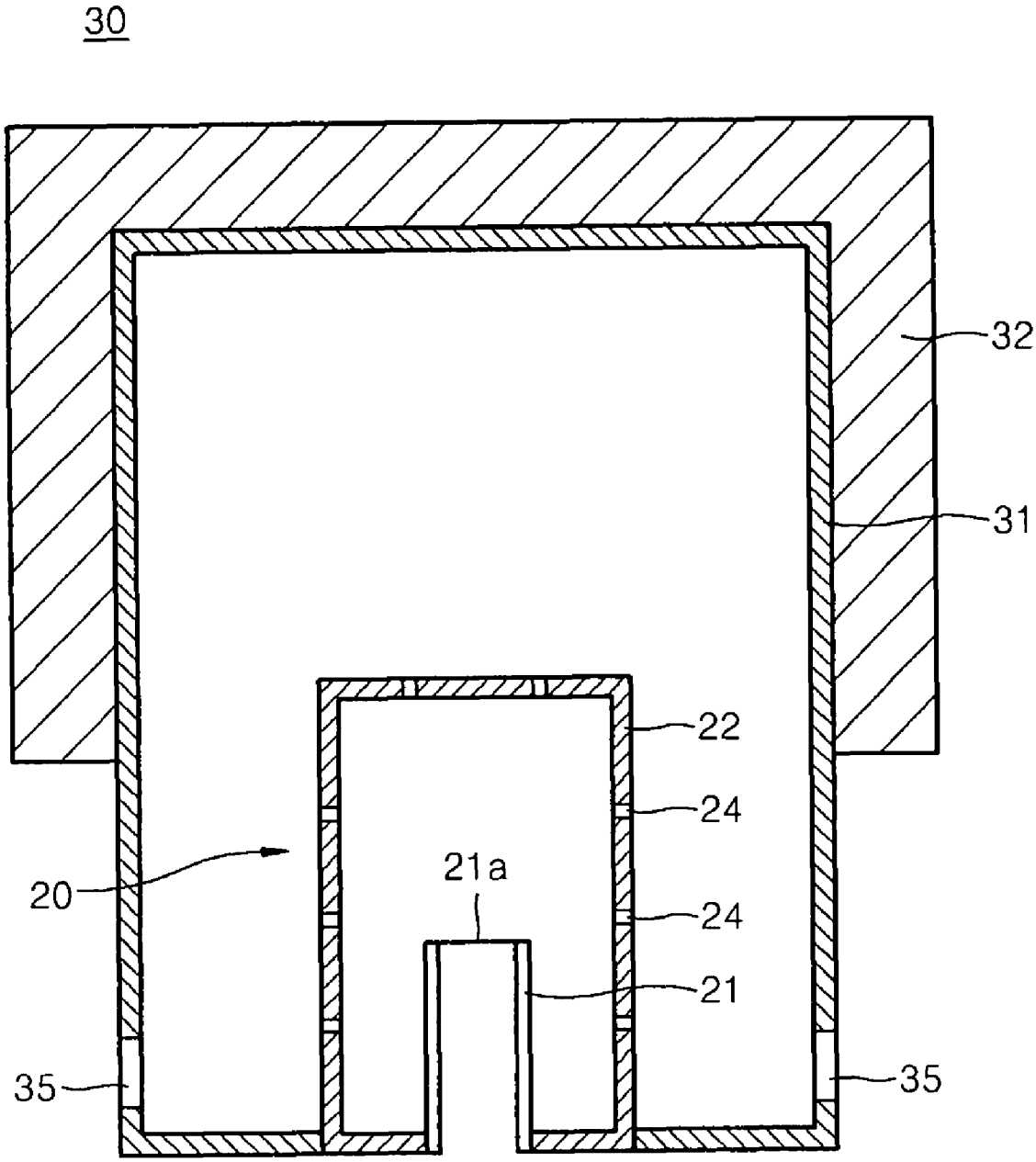
FIG. 5 is a cross-sectional view illustrating the structure of a reformer including the reformer burner of FIG. 4.

FIG. 4 is a cross-sectional view illustrating a structure of a reformer burner 20 according to an embodiment of the present invention, and FIG. 5 is a cross-sectional view illustrating a structure of a reformer including the reformer burner of FIG. 4.

FIG. 4 illustrates a reformer burner 20 demonstrating aspects of the current invention. The reformer burner 20 comprises a fuel supply chamber 22, through which a plurality of atomizing holes 24 extend, and a fuel supply tube 21, having a fuel injection hole 21*a* at an end located within the fuel supply chamber 22. The reformer burner 20 heats the combustion chamber of the reformer (not shown) through combustion of a fuel delivered to the fuel supply chamber 22 through the fuel supply tube 21. Upon arrival in the fuel supply chamber 22, the fuel is dispersed and atomized as it flows out of the fuel supply chamber 22 through the plurality of atomizing holes 24, at which time it is ignited. The fuel may be a gaseous fuel or a liquid fuel, or a mixture of the two, delivered to the fuel supply tube 21 along with air.

The fuel supply tube 21 may have a pipe shape. The fuel supply tube 21 may be arranged to extend to the center of the fuel supply chamber 22. Or, the fuel supply tube 21 may be arranged to extend towards but not completely to the center of the fuel supply chamber 22. Although the fuel supply tube 21 is depicted as being inside and separate from the fuel supply chamber 22, the fuel supply tube 21 and the fuel supply chamber 22 may be combined to achieve both fuel supply and atomization. For example, a fuel supply tube may include atomization holes throughout the length of the fuel supply tube so that the fuel is distributed directly from the fuel supply tube to the combustion chamber through the atomization holes.

Referring to FIG. 5, the reformer 30 comprises a combustion chamber 31, in which fuel is combusted; a reformer catalyst 32 arranged about the combustion chamber 31; a plurality of gas outlets 35; and the reformer burner 20 of FIG. 4. The reformer burner 20 again comprises a fuel supply tube 21 having a fuel injection hole 21*a*; a fuel supply chamber 22 through which a plurality of atomizing holes 24 extend. The reformer burner 20 is installed such that the fuel supply chamber 22 extends toward the center of the reformer 30 if not all the way to the center of the reformer 30. The fuel supply chamber 22 may be formed of a heat resistant material that can withstand a firing temperature of approximately 1000° C. The fuel supply chamber 22 may be formed of stainless steel or a ceramic material. The stainless steel can be SUS301 stainless steel. The ceramic material can be alumina.

The fuel supply tube 21 may be disposed to protrude from a lower center of the fuel supply chamber 22. The fuel supply tube 21 may have a pipe shape. The fuel supply chamber 22 is installed to protrude from a lower central portion of the reformer 30.

The plurality of atomizing holes 24 are formed in the fuel supply chamber 22. Fuel supplied through the fuel supply tube 21 passes through fuel injection hole 21*a* and is atomized into the combustion chamber 31 of the reformer 30 through the atomizing holes 24. The combustion exhaust generated by the combustion of the fuel in the combustion chamber 31 of the reformer 30 is released through the plurality of gas outlets 35. The diameter of the atomizing holes 24 should be designed to prevent flashback of the flame into the fuel supply tube 21. The atomizing holes 24 may vary according to fuel used. In the case of hydrogen gas, which has a high migration rate, the diameter of the atomizing holes 24 should be 0.76 mm or less, otherwise the flame will burn back into the fuel supply tube 21. In the case of methane gas, the diameter of the atomizing holes 24 can be 3.3 mm or less. The limits of the diameter of the atomizing holes 24 depend on the fuel used and vary according to the flow rate of the fuel, whether the fuel is liquid or gas, and the migration rate of the fuel, among other factors.

The number of the atomizing holes 24 may vary according to the requirements of the reformer 30. Although fuels other than hydrogen may be supplied through the fuel supply tube 21, an embodiment of the current invention recovers unreacted hydrogen from the fuel cell stack to supply, to the fuel supply tube 21 alone or mixed with other fuels for burning in the reformer burner 30. Therefore, the diameter of the atomizing holes 24 may be designed on the basis of burning hydrogen.

The atomization of the fuel through atomizing holes 24 in fuel supply chamber 22 increases the uniformity of distribution of the fuel through out the combustion chamber 31 so as to decrease the temperature variations throughout the combustion chamber 31, thereby increasing the uniformity in heating the reformer catalyst 32. And, a more evenly heated reformer catalyst 32 increases the reformers efficiency and will prolong the life of the catalyst.

Figure 3:
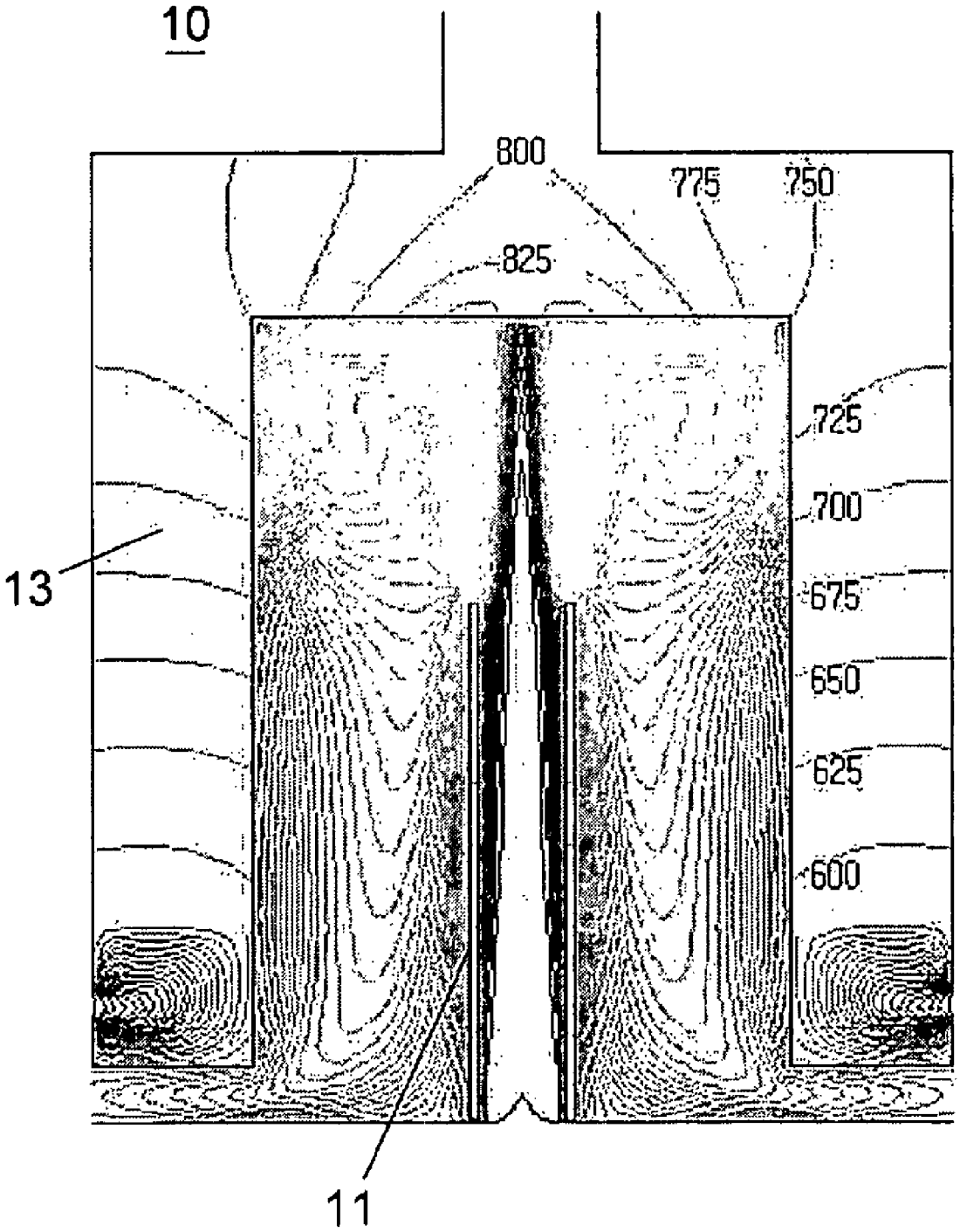
FIG. 3 (RELATED ART)
FIG. 3 is a diagram showing a simulated temperature profile in the reformer of FIG. 2.
Figure 6:
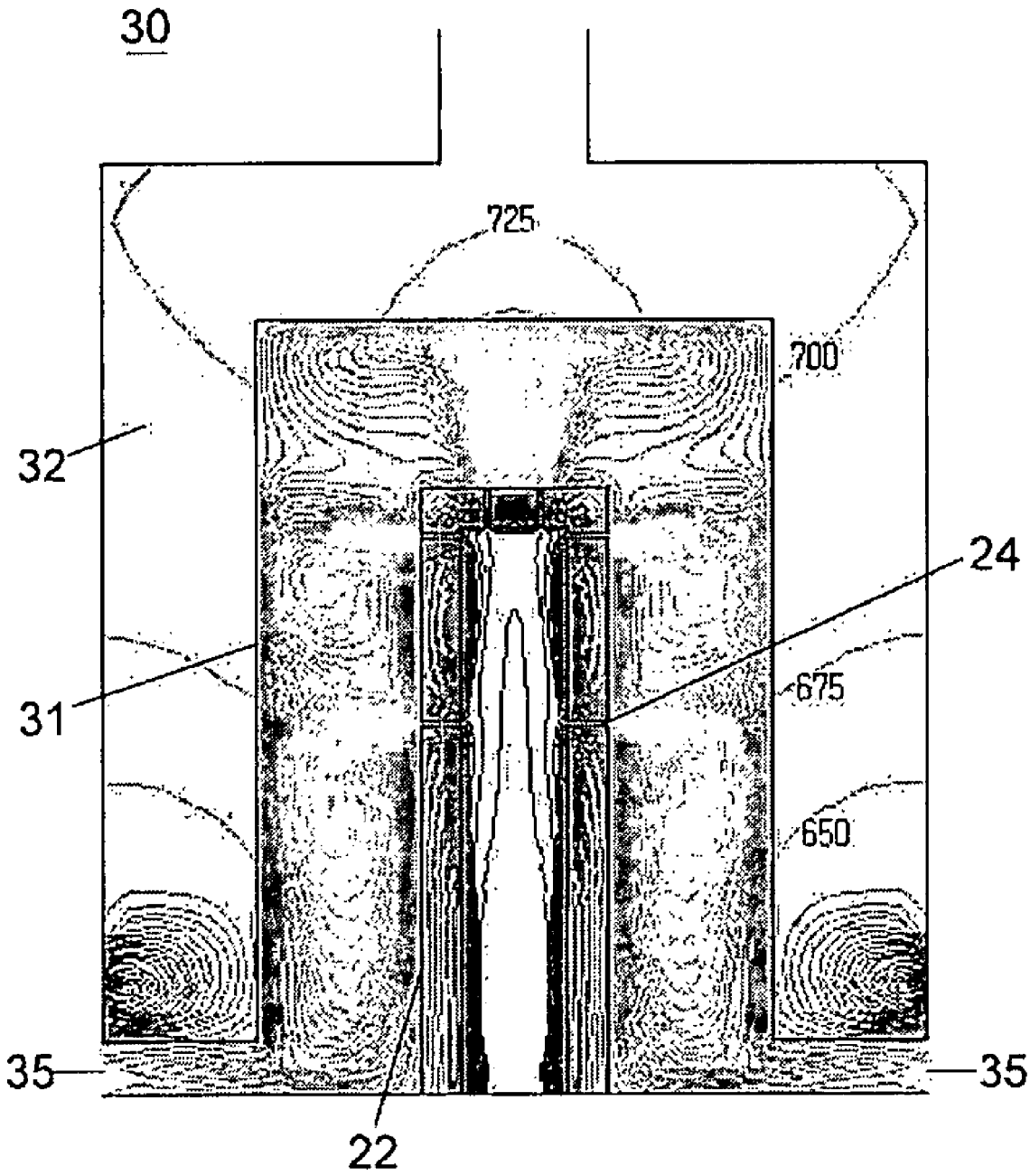
FIG. 6 is a diagram showing a simulated temperature profile in the reformer burner of FIG. 4.

FIG. 6 is a diagram illustrating a simulated temperature profile for the reformer of FIG. 5, featuring an embodiment of the present invention. Referring to FIG. 6, the temperature profile of the reformer catalyst 31 shows a very uniform distribution between 650° C. and 725° C. Compared to the simulated temperature profile for the related art found in FIG. 3, the demonstrated aspects of the current invention substantially outperform the related art. The temperature range for the reformer catalyst in the related art was 600° C. to 825° C.-a 225° C. difference; whereas, aspects of the current invention demonstrate that the temperature differences can be reduced to only a 75° C. difference. The uniform temperature profile in the reformer catalyst 32 increases the reforming efficiency of the fuel and reduces the area required for contact between the reformer catalyst 32 and combustion chamber 31, thereby reducing the volume of the reformer 30.

Figure 7:
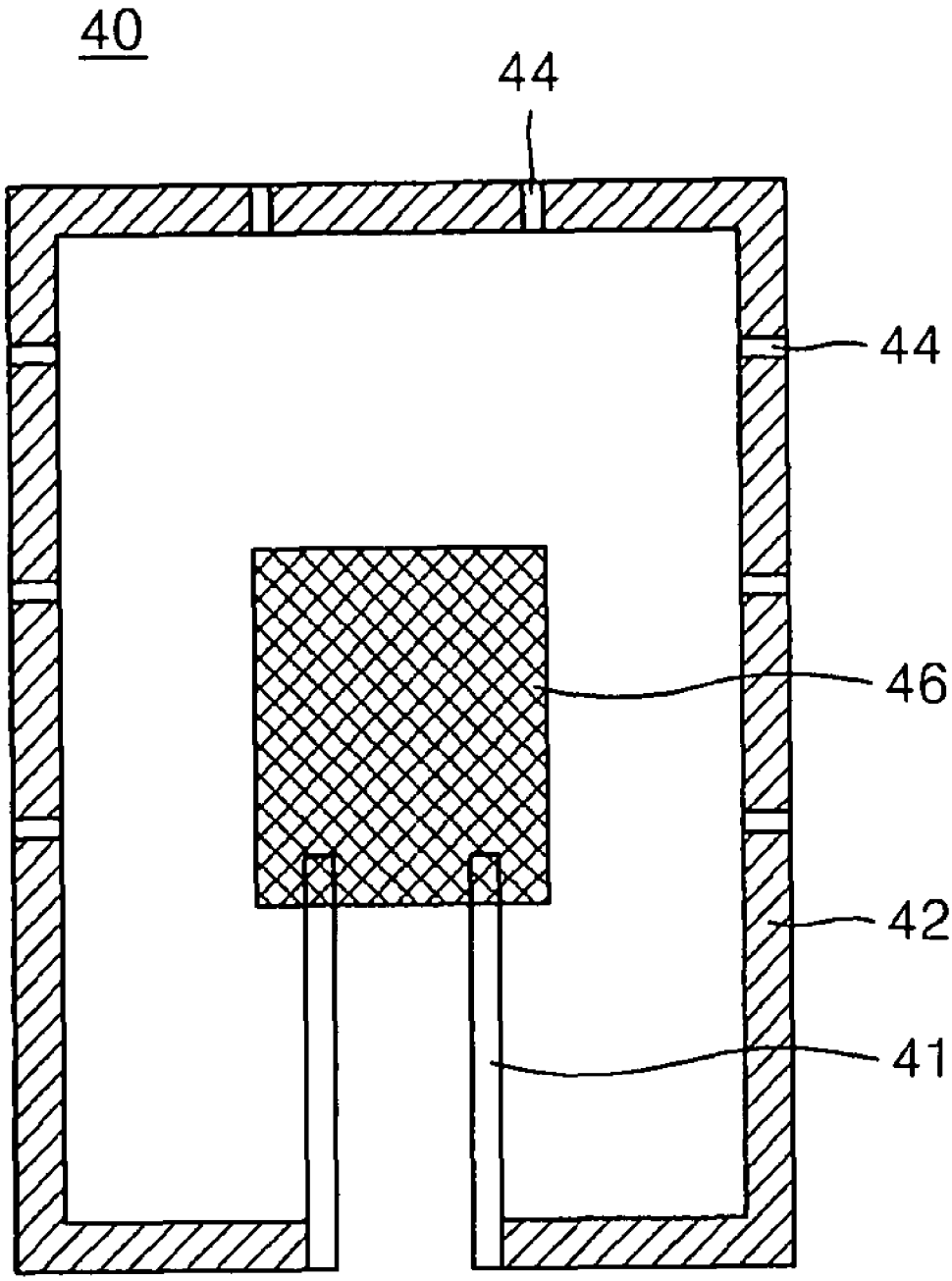
FIG. 7 is a cross-sectional view illustrating a structure of a reformer burner according to another embodiment of the present invention.
Figure 8:
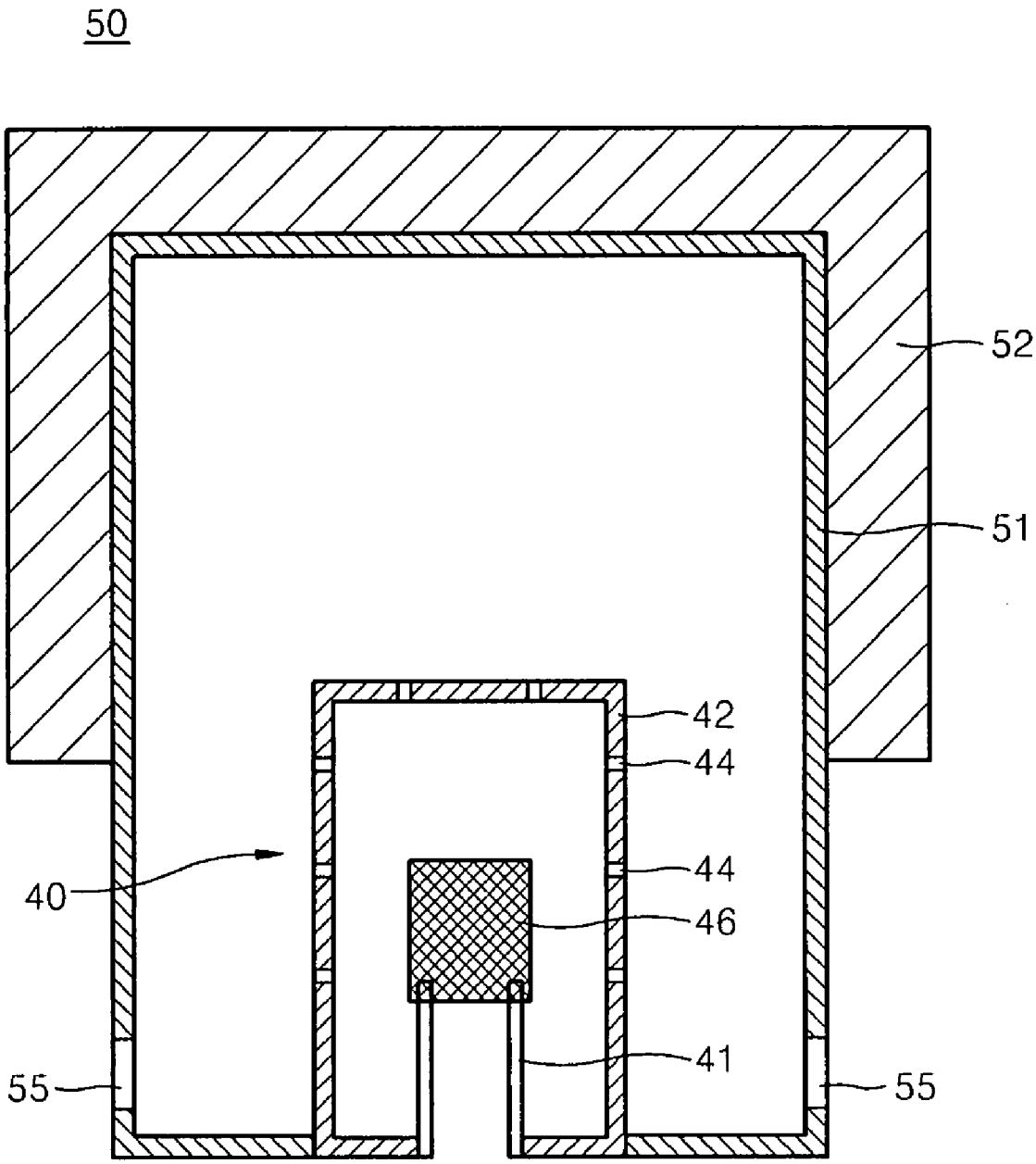
FIG. 8 is a cross-sectional view illustrating a structure of a reformer including the reformer burner of FIG. 7.

FIG. 7 is a cross-sectional view illustrating a structure of a reformer burner 40 according to another embodiment of the present invention, and FIG. 8 is a cross-sectional view illustrating a structure of a reformer including the reformer burner of FIG. 7.

Referring to FIG. 7, the reformer burner 40 comprises a fuel supply chamber 42, through which a plurality of atomizing holes 44 extend, and a fuel supply tube 41, extending into the fuel supply chamber 42, with a cylinder mesh 46 arranged about the fuel supply tube 41 within the fuel supply chamber 42. The reformer burner 40 heats the combustion chamber of the reformer (not shown) through combustion of a fuel delivered to the fuel supply chamber 42 through the fuel supply tube 41. The fuel flows through fuel supply tube 41 and encounters the cylinder mesh 46, which facilitates the uniform distribution of the fuel about the fuel supply chamber 42 so that the fuel may be more uniformly atomized through atomizing holes 44. The fuel may be a gaseous fuel or a liquid fuel along with air, or a mixture of the two, delivered to the fuel supply tube 21.

The fuel supply tube 41 extends to the center of the fuel supply chamber 42, or extends toward but not completely to the center of the fuel supply chamber 42 and may be disposed to protrude from a lower portion of the fuel supply chamber 42. The fuel supply tube 41 may have a pipe shape. The fuel supply chamber 42 may be installed to protrude from a lower central portion of the reformer 10.

Referring now to FIG. 8, a plurality of atomizing holes 44 are formed in the fuel supply chamber 42. A fuel supplied through the fuel supply tube 41 is atomized into a combustion chamber 51 of the reformer 50 through the atomizing holes 44. The diameter of the atomizing holes 44 again should be designed to prevent flashback of the flame into the fuel supply tube 41, and may vary according to fuel used. In the case of hydrogen gas which has a high migration rate, the diameter of the atomizing holes 44 should be 0.76 mm or less. The number of the atomizing holes 44 may vary according to requirements of the reformer 50.

The fuel supply chamber 42 may be arranged so as to extend to the center of the combustion chamber 51, or the fuel supply chamber 42 may be arranged so as to extend toward the center but not completely to the center of combustion chamber 51. The fuel supply chamber 42 may be formed of a heat resistant material that can withstand a firing temperature of approximately 1000° C., which is the maximum combustion temperature, such as a stainless steel or a ceramic material. The stainless steel can be SUS301 stainless steel, and the ceramic material can be alumina.

The cylinder mesh 46 facilitates uniform distribution of a fuel entering through the fuel supply tube 41 in the fuel supply chamber 42 so that the fuel is uniformly atomized through the atomizing holes 44.

A reformer burner exhibiting aspects of the present invention allows for a more uniform temperature profile throughout the reformer and the reformer catalyst. Such uniformity results in more efficient production of hydrogen by the reformer catalyst. Furthermore, the temperature uniformity throughout the catalyst will extend the life of the catalyst as there will be less stress due to temperature variations. Also, the uniform temperature profile in the reformer catalyst increases the reforming efficiency of the fuel and reduces the area required for contact between the reformer catalyst and combustion chamber, thereby reducing the volume of the reformer. Thus, the size of the reformer can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A reformer burner disposed in a combustion chamber of a fuel reformer, to heat a reformer catalyst disposed on the combustion chamber, the reformer burner comprising:

a fuel supply chamber disposed within the combustion chamber, having atomizing holes through which a fuel flows into the combustion chamber; and a fuel supply tube extending into the fuel supply chamber, to supply the fuel to the fuel supply chamber, wherein the atomizing holes are disposed such that combustion of the fuel occurs on all of the external surfaces of the fuel supply chamber that face the combustion chamber, so as to evenly heat the combustion chamber.

2. The reformer burner of claim 1, wherein the atomizing holes have a diameter sufficient to control flashback of the fuel from the combustion chamber to the fuel supply chamber.

3. The reformer of claim 2, wherein the atomizing holes have a diameter of 3.3 mm or less.

4. The reformer of claim 3, wherein the atomizing holes have a diameter of 0.76 mm or less.

5. The reformer of claim 1, wherein a distal end of the fuel supply tube extends toward a center of the fuel supply chamber to distribute fuel throughout the fuel supply chamber.

6. The reformer of claim 5, wherein the distal end of the fuel supply tube extends to the center of the fuel supply chamber.

7. The reformer burner of claim 1, wherein the fuel supply chamber is formed of a heat resistant material.

8. The reformer burner of claim 7, wherein the heat resistant material is a heat resistant metal.

9. The reformer burner of claim 8, wherein the heat resistant metal is SUS301 stainless steel.

10. The reformer burner of claim 7, wherein the heat resistant material is a ceramic material.

11. The reformer burner of claim 10, wherein the ceramic material is alumina.

12. The reformer burner of claim 1, wherein the fuel supply tube is disposed on a lower central portion of the fuel supply chamber.

13. The reformer burner of claim 1, wherein the fuel supply chamber is disposed on a lower central portion of the reformer.

14. The reformer burner of claim 1, further comprising a cylinder mesh on a distal end of the fuel supply tube.

* * * * *